US009035559B2

(12) United States Patent
Han

(10) Patent No.: US 9,035,559 B2
(45) Date of Patent: May 19, 2015

(54) LIGHT STRING

(71) Applicant: Houhua Han, Suizhou (CN)

(72) Inventor: Houhua Han, Suizhou (CN)

( * ) Notice: Subject to any disclaimer, the term of this patent is extended or adjusted under 35 U.S.C. 154(b) by 0 days.

(21) Appl. No.: 14/161,727

(22) Filed: Jan. 23, 2014

(65) Prior Publication Data

US 2014/0300287 A1 Oct. 9, 2014

Related U.S. Application Data

(63) Continuation-in-part of application No. 13/915,668, filed on Jun. 12, 2013.

(30) Foreign Application Priority Data

Apr. 8, 2013 (CN) ..... 2013 2 0169368 U
Apr. 18, 2013 (CN) ..... 2013 2 0197290 U

(51) Int. Cl.
*H05B 39/00* (2006.01)
*F21S 4/00* (2006.01)

(52) U.S. Cl.
CPC ..... *F21S 4/001* (2013.01); *H05B 39/00* (2013.01)

(58) Field of Classification Search
CPC ..... F21S 4/00
USPC ..... 315/188, 185 S
See application file for complete search history.

(56) References Cited

U.S. PATENT DOCUMENTS

| | | | | | |
|---|---|---|---|---|---|
| 4,972,123 | A * | 11/1990 | Gerfast | 315/200 R |
| 4,982,137 | A * | 1/1991 | Kichibayashi et al. | 315/107 |
| 5,327,048 | A * | 7/1994 | Troy | 315/240 |
| 5,343,122 | A * | 8/1994 | Sugimori et al. | 315/209 R |
| 7,279,809 | B2 | 10/2007 | Janning | |
| 8,324,820 | B2 | 12/2012 | Janning | |
| 2009/0128042 | A1 * | 5/2009 | Janning | 315/122 |

* cited by examiner

*Primary Examiner* — Crystal L Hammond
(74) *Attorney, Agent, or Firm* — Hemisphere Law, PLLC

(57) ABSTRACT

A light string includes a plurality of incandescent filament lamps. The incandescent filament lamps are electrically connected in series and powered by an AC power supply. Each incandescent filament lamp is connected in parallel to a capacitor. The capacitors are polarized electrolytic capacitors. A capacitance of each capacitor is 47 microfarads~120 microfarads. A rated voltage of each capacitor is 16 volts ~100 volts and is higher than a rated voltage of each incandescent filament lamp. When one of the incandescent filament lamps is failed, the capacitor with which the failed one of the incandescent filament lamps is connected in parallel operates normally and performs power compensation and electrical connection during its repeatedly charging and discharging. When the light string is powered on, the capacitor is charged and absorbs the surge current which may occur. Thus, the voltage dropped on each light rises slowly and the lights are safe.

2 Claims, 1 Drawing Sheet

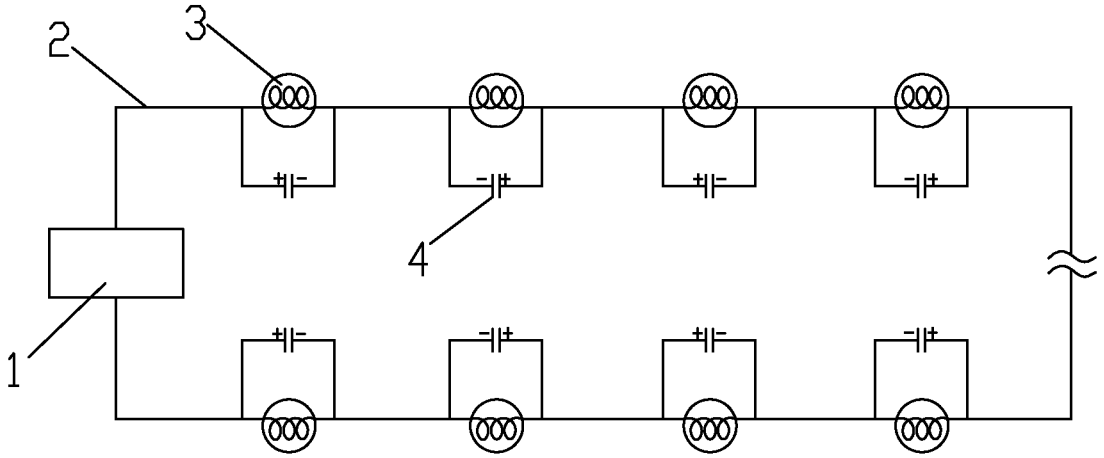
2
3
4
1

LIGHT STRING

CROSS-REFERENCE TO RELATED APPLICATIONS

The present application is a continuation-in-part of U.S. application Ser. No. 13/915,668, filed on Jun. 12, 2013, which claims priority of China Patent Application No. 201320169368.1, filed on Apr. 8, 2013 and China Patent Application No. 201320197290.4, filed on Apr. 18, 2013, each of which are incorporated herein by reference.

BACKGROUND OF THE INVENTION

1. Field of the Invention

The invention relates to electric light strings.

2. Description of Related Art

Light strings are widely used for decorative purposes, especially for holiday lighting. Light strings refer to incandescent filament lamps or LED lamps connected electrically in a series. Generally, a light string includes more than 10 incandescent filament lamps, and is powered by mains electricity, such as 110V AC mains electricity. Thus, a voltage supplied on each incandescent filament lamp is 1.5V to 12V. When the light string is powered on, a surge current may be generated and may burn out the incandescent filament lamp bulb mounted in a lamp base. In the conventional light strings, when the filament of the incandescent filament lamp bulb fails and the bulb remains in the string, or when the bulb is removed from its socket for replacement, the closed path for the flow of electrical current is interrupted and the remainder of the lamps in the string will no longer be illuminated.

U.S. Pat. No. 8,324,820 for capacitor shunted LED light string discloses a capacitor shunt across terminals of each LED light. When one LED light fails, the capacitor with which the failed LED light is connected to in parallel is broken down and shorts out, thus continues current in the light string, and keeps the light string illuminated. However, the capacitor shunt has several disadvantages.

Firstly, when one LED light fails, the corresponding capacitor shorts out, and a voltage drop on the failed part (composed of the failed LED light and the shorted-out capacitor) become lower than before, thus a voltage drop cross the other LED light rises accordingly. When more and more LED lights fails, the voltage drop cross each normal LED light rises significantly. As we know, when voltage drop across an LED is twice than the rated voltage of an LED, the LED will burn up in an hour because of over-heat. Thus, when more and more LED lights fails, the remained LED lights may all burned up.

Secondly, the low break-down voltage chip capacitor is not suitable for hight-power incandescent filament lamps, because the line current is much larger than that in a LED light, and the broken-down capacitor will be over-heat rapidly, and will be destroyed and invalid.

Thirdly, the manufacturing cost of the break-down capacitor is high and too pricey to be practical.

BRIEF SUMMARY OF THE INVENTION

An object of the present invention is to provide an improved light string, when the filament of the incandescent filament lamp (tungsten filament lamp) fails and the bulb remains in the light string, or when the bulb is removed from its socket for replacement, the closed path for flow of electrical current is still closed, and the surge current can be absorbed.

A light string includes a plurality of incandescent filament lamps. The incandescent filament lamps are electrically connected in series and powered by an AC power supply. Each incandescent filament lamp is connected in parallel to a capacitor. The capacitors are polarized electrolytic capacitors. A capacitance of each capacitor is 47 microfarads~120 microfarads. A rated voltage of each capacitor is 16 volts ~100 volts and is higher than the rated voltage of each incandescent filament lamp. When one of the incandescent filament lamps is failed, the corresponding capacitor with which the one of the incandescent filament lamps is connected to in parallel operates normally.

The capacitors can be connected in the light string terminal forwardly or reversely.

Each incandescent filament lamp of the light string of the present invention is electrically connected in parallel to a large value capacitor. When the light string is powered on, the capacitor is charged and absorbs the surge current which may occur. Thus, the voltage dropped on each incandescent filament lamp rises slowly and the incandescent filament lamps are safe. The capacitor also performs power compensation and electrical connection by its repeatedly charging and discharging. When the filament of the light bulb fails and the bulb remains in the light string, or when the bulb is removed from its socket for replacement, the capacitor with which the failed or removed one of lamps is connected to in parallel operates normally and is charged and discharged to realize electrical connection, thus, the closed path for flow of electrical current is still closed. Furthermore, when an incandescent filament lamp fails, a voltage drop on the failed part become slightly larger than before, thus the remained incandescent filament lamps will not be under a risk of being burned down caused by over-voltage.

BRIEF DESCRIPTION OF THE SEVERAL VIEWS OF THE DRAWING(S)

The foregoing and other exemplary purposes, aspects and advantages of the present invention will be better understood in principle form the following detailed description of one or more exemplary embodiments of the invention with reference to the drawing(s), in which:

The FIGURE is a circuit diagram of a light string in accordance with an embodiment of the invention.

DETAILED DESCRIPTION OF THE INVENTION

The invention will now be described in detail through several embodiments with reference to the accompanying drawing.

Referring to the FIGURE, a light string according to the embodiment of the present invention mainly includes a plurality of incandescent filament lamps 3 which are electrically connected in series by wires 2. The plurality of incandescent filament lamps 3 may be electrically connected to an AC power supply via a power plug 1. The AC power supply is preferably AC mains electricity. The incandescent filament lamps 3 are tungsten filament lamps. As a rated voltage of the incandescent filament lamps 3 is low, generally 1.5 volts to 12 volts, the light string usually includes more than 10 incandescent filament lamps when connecting to 110V mains electricity.

In the embodiment, each incandescent filament lamp 3 is electrically connected in parallel to a capacitor 4. The capacitors are polarized electrolytic capacitors, and can be connected in the light string terminal forwardly or reversely. A capacitance of each capacitor is 47 microfarads~120 microfarads (μF) , and preferably 70~120 μF. A rated voltage of each capacitor is 16 volts ~100 volts, and is at least twice as much as that of each incandescent filament lamp. When a rated voltage of an incandescent filament lamp 3 is 2.5V and a rated current is 0.17 A, a 100 μF, 16V capacitor is preferably adopted. When a rated voltage of an incandescent filament lamp is 12V and a rated current is 0.08 A, a 100 μF, 25V capacitor is preferably adopted. In this way, when the light string is powered on, the capacitors 4 are charged and absorb the surge current in the wires 2. Thus, the voltage dropped on each incandescent filament lamp 3 rises slowly and the incandescent filament lamps 3 are safe. The capacitor 4 also performs power compensation and electrical connection by repeatedly charging and discharging.

When the filament of the incandescent filament lamp fails and the bulb remains in the light string, or when the bulb is removed from its socket for replacement, because the rated voltage of the capacitor with which the failed or removed lamps is connected to in parallel is much larger than that of the incandescent filament lamp and the capacitance of the capacitor is large, the capacitor can operate normally (not been breakdown and destroyed), and is charged and discharged repeatedly to realize electrical connection, thus, the closed path for flow of AC electrical current is still closed and allows the remaining incandescent filament lamps to continue to glow.

Furthermore, because an effective impedance of the capacitor is larger than that of an incandescent filament lamp, a voltage drop across the failed part become slightly larger than before, and each voltage drop across the normal light is lowered down slightly, thus the other incandescent filament lamps will not be burned down caused by over-voltage.

It is understandably, in other embodiments, only a part of the incandescent filament lamps 3 in the light string is connected in parallel to a capacitor 4. Polarized electrolytic capacitors have the advantages of manufacture and low cost. As the capacitors can be connected in the light string terminal regardless of their polarity, they can be connected in the circuit forwardly or reversely, convenient assembly.

Generally, each incandescent filament lamp 2 includes a bulb and a socket for holding the bulb. The socket is configured electrical connectors (generally two sheets) for electrically connecting the pins of the bulb. The capacitor 4 may electrically connect to the electrical connectors to realize the parallel connection to the bulb.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A light string, comprising a plurality of incandescent filament lamps, the incandescent filament lamps being electrically connected in series and powered by an AC power supply;

wherein each incandescent filament lamp is connected in parallel to a capacitor; the capacitors are polarized electrolytic capacitors, a capacitance of each capacitor is 47 microfarads~120 microfarads; a rated voltage of each capacitor is 16 volts ~100 volts and is higher than a rated voltage of each incandescent filament lamp; when one of the incandescent filament lamps fails, the capacitor with which the failed one of the incandescent filament lamps is connected to in parallel operates normally; the capacitors are connected in the light string terminal forwardly and reversely.

2. The light string of claim 1, wherein adjacent electrodes of any two adjacent capacitors of the capacitors are opposite.

* * * * *